United States Patent [19]

Stolpen

[11] 4,158,921

[45] Jun. 26, 1979

[54] EDUCATIONAL TEACHING AND SELF-CORRECTING APPARATUS ADAPTABLE TO A VARIETY OF SUBJECT MATTERS

[76] Inventor: Beulah H. Stolpen, 282 North Ave., Westport, Conn. 06880

[21] Appl. No.: 831,645

[22] Filed: Sep. 8, 1977

Related U.S. Application Data

[63] Continuation of Ser. No. 694,922, Jun. 11, 1976, abandoned, which is a continuation-in-part of Ser. No. 470,184, May 15, 1974, abandoned, which is a continuation of Ser. No. 213,447, Dec. 29, 1971, abandoned.

[51] Int. Cl.[2] ..... A63H 33/04; A63F 9/04

[52] U.S. Cl. ..... 35/70; 273/146; 35/72

[58] Field of Search ..... 273/146, 156; 35/69, 35/70, 71, 72, 35 J; D34/5 DT, 15 FF

[56] References Cited

U.S. PATENT DOCUMENTS

| | | | |
|---|---|---|---|
| 557,307 | 3/1896 | Foster | 35/71 |
| 717,105 | 12/1902 | Mansfield | 35/71 |
| 740,451 | 10/1903 | Mansfield | 35/71 |
| 1,481,628 | 1/1924 | Souza | 273/146 |
| 1,684,609 | 9/1928 | Walker | 273/146 |
| 2,386,114 | 10/1945 | Hayes | 35/69 |
| 2,483,833 | 10/1949 | Levin | 35/71 |
| 3,399,897 | 9/1968 | Mitchell | 273/146 |
| 3,608,906 | 9/1971 | Odier | 273/146 X |
| 3,799,554 | 3/1974 | Simons | 273/146 |

FOREIGN PATENT DOCUMENTS

| | | | |
|---|---|---|---|
| 640413 | 3/1964 | Belgium | 35/71 |
| 554824 | 3/1923 | France | 35/69 |

*Primary Examiner*—Richard C. Pinkham
*Assistant Examiner*—Arnold W. Kramer
*Attorney, Agent, or Firm*—E. Barron Batchelder

[57] ABSTRACT

This invention relates to a manipulative self-correcting educational apparatus and method for teaching relationships, similarities and differences in a number of subject matters. It includes one or a plurality of structured, multi-faceted, or facially incremented units bearing a plurality of at least two sets of indicia on each unit: each set of indicia bearing a relationship on at least two of its surfaces, so structured that manipulation of the unit discloses the relationship, or lack of it, in a self-correcting method of positioning of the related and unrelated surfaces on each individual unit or on a plurality of units.

4 Claims, 25 Drawing Figures

MOTHER
MADRE
FATHER
BROTHER SISTER
PADRE
HERMANO HERMANA

WASHING-TON
TOKYO
UNITED STATES
JAPAN
PARIS
FRANCE

INCHES
MILLIMETER
X25
FEETI-METER
X30
FEET

3 +
4
7
2
10
8 +

1
2
ONE
TWO

SHARP
BASS

THIN
SLIM
LARGE
GOOD
BAD
ROUGH
FOR
FOUR
SAIL

SALT
NaCl
SOLID
WATER

EDUCATIONAL TEACHING AND SELF-CORRECTING APPARATUS ADAPTABLE TO A VARIETY OF SUBJECT MATTERS

This is a continuation of application Ser. No. 694,922, filed June 11, 1976, which is a continuation-in-part of application Ser. No. 470,184, filed May 15, 1974, which is a continuation of application Ser. No. 213,447, filed Dec. 29, 1971, all of which are abandoned.

BACKGROUND OF THE INVENTION

In order to better understand the invention and necessities leading thereto, a brief commentary and some historical background will be helpful.

As long as Plato, who said: "Let early education be a sort of amusement, you will then better discover the natural bent.", teachers have been seeking more enjoyable means and methods to inspire the learner to further exploration and self-discovery of subject matter.

How does one capture the thrill of learning? Surely its capture is critical. With it the sublime and impossible come into reach, without it man is capable only of mundane and routine.

Tragically, too many children never know that thrill of learning because of an introduction to learning that stifled their creative seeking and the satisfaction of self discovery. For fear of consequences of being wrong, they built protective shells around themselves to shield them from failure and unhappiness, the heartaches that come from their first faltering explorations into the unknown, and meeting with failure and embarrassment, all embarrassment that deepens with each successive failure, and negatively shapes their futures.

To ignite the spark of learning is an eternal purpose. Unfortunately, too many teachers depend entirely on prescribed methodology and materials and scrupulously follow guides and rote learning. Therefore, it is essential that materials and methods be available that will help them ignite this spark by presenting patterns of learning that are programmed to satisfy the needs of such teachers and yet are sufficiently manipulative to encourage exploration and self-discovery, with self-correcting processes that being successful results: materials that will inspire creativity and imagination on the parts of both the teachers and the learners.

Carlyle has said: "A thought once awakened does not slumber." It is essential to awaken the thoughts of learners in successful understanding of basic patterns so that they build on firm foundations.

Jerome Brumer of Harvard, foremost behavioral scientist, has stated that "There is nothing that cannot be learned at any age if it is properly introduced."

The object of the present invention is basically to provide a tool consistent with that philosophy.

Barbel Inhelder, principal co-worker of Piaget, has shown that the "operative" aspect of knowledge is equally as important as the "figurative" aspect. To be able to physically arrange elements in an ordered sequence supports the memory. The "figurative" aspects of knowledge: perception, imitation and images need the support of "operative" schemes on which the element of comprehension—which is nearly always present in memory behavior—depends.

Some people learn better through their eyes; some through their ears; and some through their sense of touch.

The Haptic Sense has not been sufficiently utilized in teaching. In the early part of this century Dr. Maria Montesorri used some such techniques; however, they are just beginning to make an impact on modern learning in the early years. There still are very few "discovery-by-manipulation" techniques available for use above this elementary grades.

The psalmist reminds us that "At its beginning the body consists of one cell, by the time of birth it has two hundred billion cells." "The story of that growth," says I. R. Richards, "presents the best instance we know of the importance of sequence or serial order. What can happen depends throughout on what has happened, and most depends on the earliest stages. Let this be our image in trying now to reflect on the place of sequence in the growth, microhierachically conducted too, of a skill, or an art, of a concept in a mind."

It is the purpose of this invention to provide "operative" tools and methods applicable to a number of subject matters that will give the user the elements of comprehension: a basic understanding of the subject; a sequential pattern; reliable reinforcement; a self-corrective device; and a "discovery" technique.

Comprehension heightens when new concepts are introduced creatively, the learners become enjoyably involved, and opportunities are presented for successful self-correcting reinforcement.

The element of play or chance is a reliable agent for reinforcement. It adds an element of excitement to the monotony of repetition. It also stimulates the interest of the slower learner through the satisfaction of successful chance.

Since it has been established that success builds on success, it is essential to build a success pattern consistent with the ability of the learner. It is a prime objective of this invention that the user experience immediate feedback and success, and be encouraged to proceed successfully at his own pace from one step to the next.

This invention will acquaint the learner with a variety of related elements via simple step-by-step sequencing to be achieved through self-correcting reinforcement. Each new learned skill will be reinforced by a series of exercises and programs emphasizing similarities, differences and relatedness.

It is also an object of this invention to provide a psychological stimulus via an element of chance combined with skill so that at the stage of mastery of each successive skill the less adept or slower learner can experience the satisfaction of winning supplied by the element of chance.

It will not be attempted to set forth and delineate all the features and advantages of the invention here. The following description, when taken in conjunction with the accompanying drawings, will make them apparent. By utilization of the invention and the data presented, the observer will be led to an understanding of concepts concerning various disciplines.

SUMMARY OF THE INVENTION

This invention is a self-correcting apparatus usable as an instructional tool, or educational game, that will provide the user with a manipulative device through the use of which many learning gains can be achieved.

It consists of one or a plurality of manipulable block-like members, each member having a plurality of faces correlated on different planes. Meaningful indicia, in the nature selectively of language (native or foreign) mathematics, geography, science, music, symbolic or pictorial representation and the like, on at least two faces of the member, co-related in substance and constituting a first set of correlated indicia in positional orientation would be so aligned in a plane of rotation or of opposing surfaces as to be positioned with one, or a plurality of other sets of correlated indicia on the same unit member.

There are a plurality of at least two identical or non-identical related members, comprising two less than two, whereby the correlation of indicia substance on one member with respect to indicia substance of a second said member will be correctly or incorrectly visually presented on adjacent ones of said members, dependent on positional arrangement of the faces of one member with respect to the faces of an adjacent member, or due to the difference in alignment of the indicia, and facilitating a user self-correction of orientation and therewith indicia substance.

The number of correlated sets of indicia on each member would be established by the arbitrary pattern determined for each application. For example: a cube member might have three sets of related indicia, each set correlated on two planes; or two sets of related indicia correlated on three planes; whereas a dodecahedron member may have two, three, four or six correlated sets each correlated on six, four, three or two planes.

The arbitrary pattern, however, must follow a pattern indigeneous to the invention that presents a correct response or an incorrect response apparent to the user for self-correcting.

Identical member units adjacently placed add another dimension to the invention. Still another dimension is added by the random casting of a plurality of identical or non-identical but related members presenting an element of chance for game play, thus reinforcing a learned skill.

A plurality of two or more groups of identical and/or non-identical related members can be correlated into a series.

It is thus apparent that the basic structure of the invention will be utilized on an individual member or unit; can be duplicated on one or a plurality of members for adjacent or random correlation of likes or differences; or sequenced with non-identical related members into an inter-related series.

It will not be attempted to set forth and delineate all the features and advantages of the invention here. The following description, when taken in conjunction with the accompanying drawings, will make them apparent. By utilization of the invention and the data presented, the observer will be led to an understanding of concepts concerning a specific discipline.

The structured multi-faceted units can be made of plastic, wood, paper, clay or other suitable material, marked by stamping, engraving, embossing or printing either directly to the surface of the unit or by the addition of removable adherents, or by any process encasing or applying the indicia on or beneath the surface of the unit.

It is understood that changes in form, proportion, size and minor features of construction within the scope of the invention may be resorted to without departing from the spirit of the invention.

Color, number, symbol or other coding device can be introduced. Differing sets on an element and/or differing identical member elements and/or differing units in a series can be individually coded. This is not an essential consideration of the invention. Such deviation from the basic premise would not alter the spirit of the invention.

Other and further objects and advantages of the invention will be more readily apparent from the following detailed description of embodiments thereof, when taken together with the accompanying drawings in which.

Figure 3:
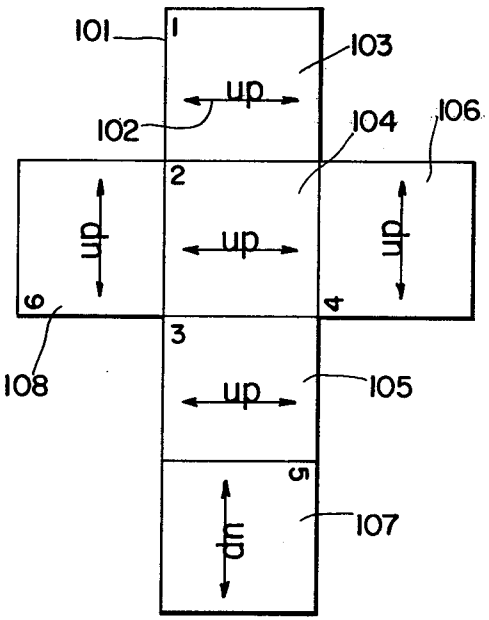
FIG. 3 is a developed view showing the relative positioning of indicia on the surfaces of a block member in cube form in a third structural orientation of the invention.
Figure 2:
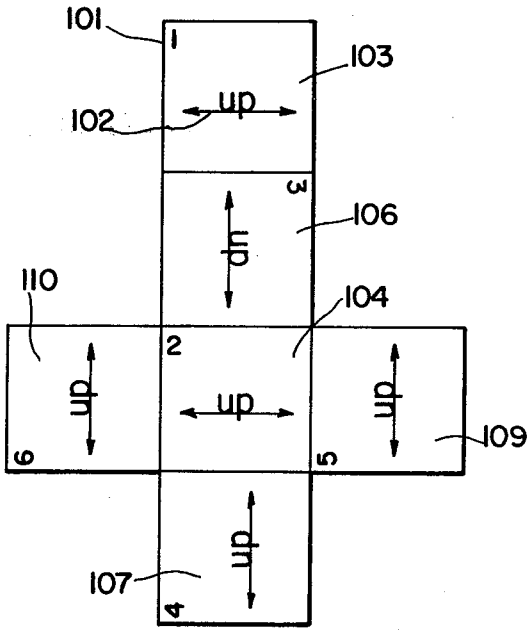
FIG. 2 is a developed view showing the relative positioning of indicia on the surfaces of a block member in cube form in a second structural orientation of the invention.
Figure 1:
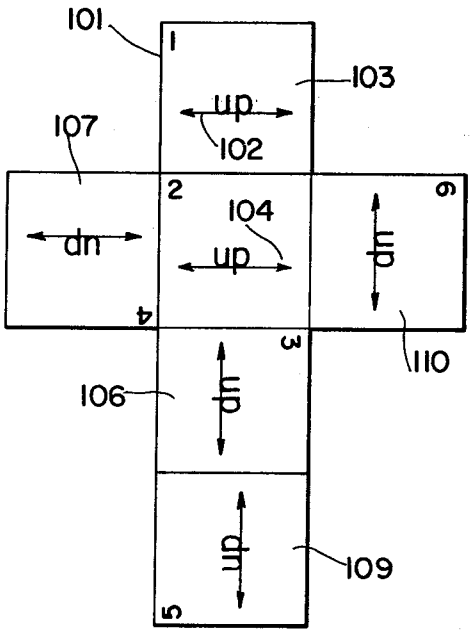
FIG. 1 is a developed view showing the relative positioning of indicia on the surfaces of a block member in cube form in one structural orientation of the invention.
Figure 6:
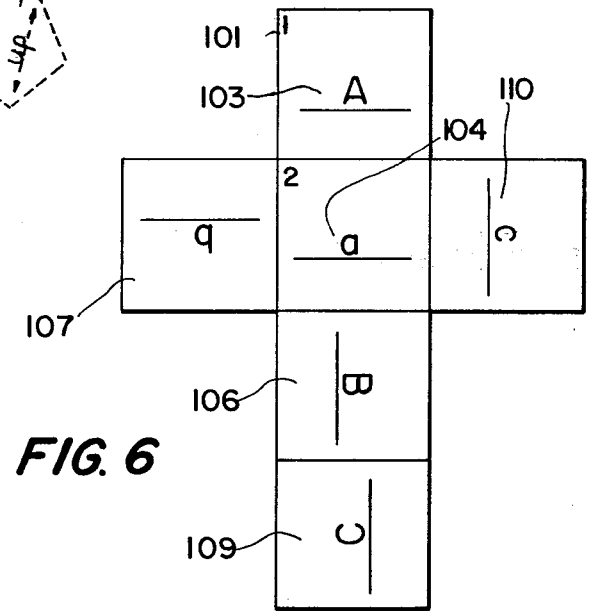
Figure 5:
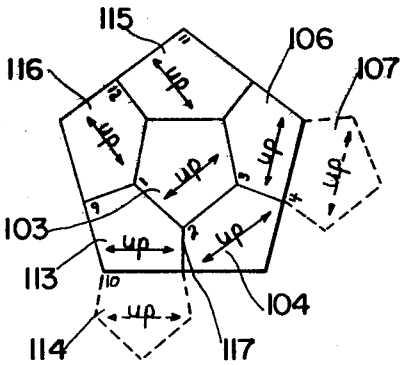
Figure 11:
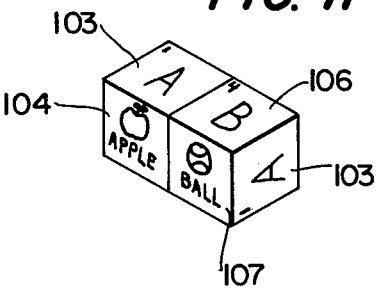
Figure 10:
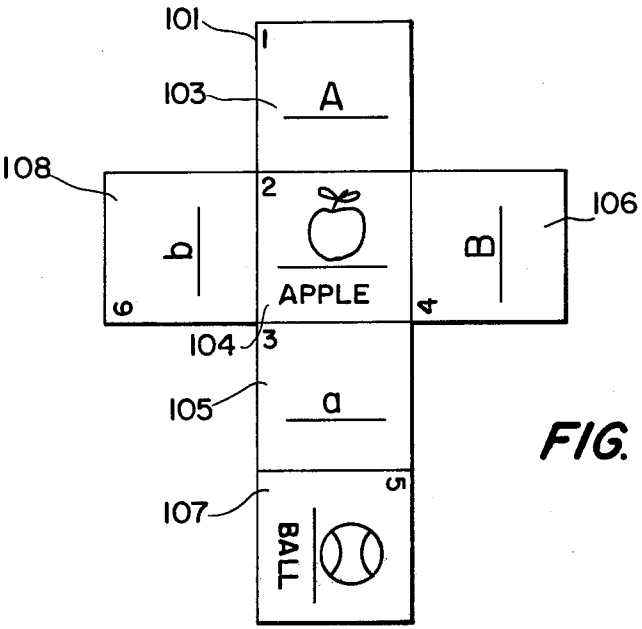
Figure 9:
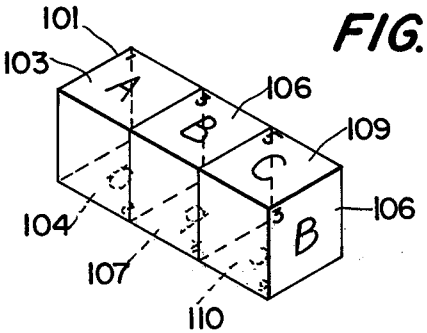
Figure 8:
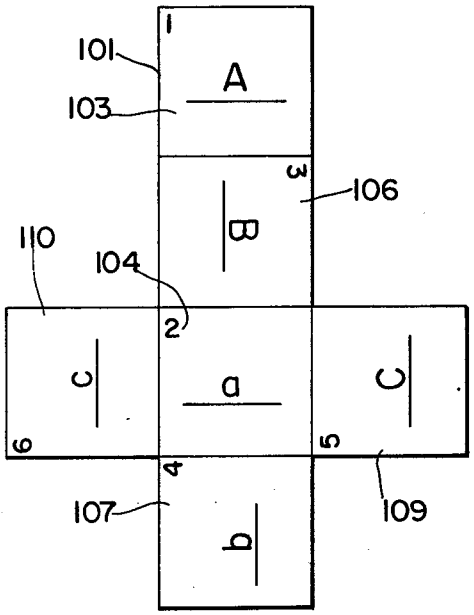

FIG. 4*a* is a developed view showing the relative positioning of indicia on eight surfaces of a prism in a fourth structural orientation of the invention;

FIG. 4*b* is a perspective view showing the relative positioning of a series of units in the orientation of FIG. 4*a* on just four surfaces of a prism;

FIG. 4*c* is a perspective view showing FIG. 4*b* turned in a different direction;

FIG. 5 is a developed view showing the relative positioning of indicia on the surfaces of a dodecahedron in a fifth structural orientation of the invention;

FIG. 6 is a developed view showing the relative positioning of one application of indicia (the letters of the alphabet) on the surfaces of a block member in cube form in the structural orientation of FIG. 1;

FIG. 7*a* is a perspective view of three identical units of FIG. 6;

FIG. 7*b* is a perspective view of three identical units of FIG. 6, comprising a second set of indicia forming a sequence to the first set of indicia (FIG. 7*a*);

FIG. 8 is a developed view showing the relative positioning on one application of indicia (the letters of the alphabet) on the surfaces of a block member in cube form in the structural orientation of FIG. 2;

FIG. 9 is a perspective view of three identical units of FIG. 8 arranged adjacently as a set (or sequence);

FIG. 10 is a developed view showing the relative positioning of one application of indicia (the letters of the alphabet) on the surfaces of a block member in cube form in the structural orientation of FIG. 3;

FIG. 11 is a perspective view of two identical units of FIG. 10, comprising the two sets of related indicia as shown on FIG. 10 in adjacent positioning.

Figures 12, 13, 14, 15, 16, 17, 18, 19:
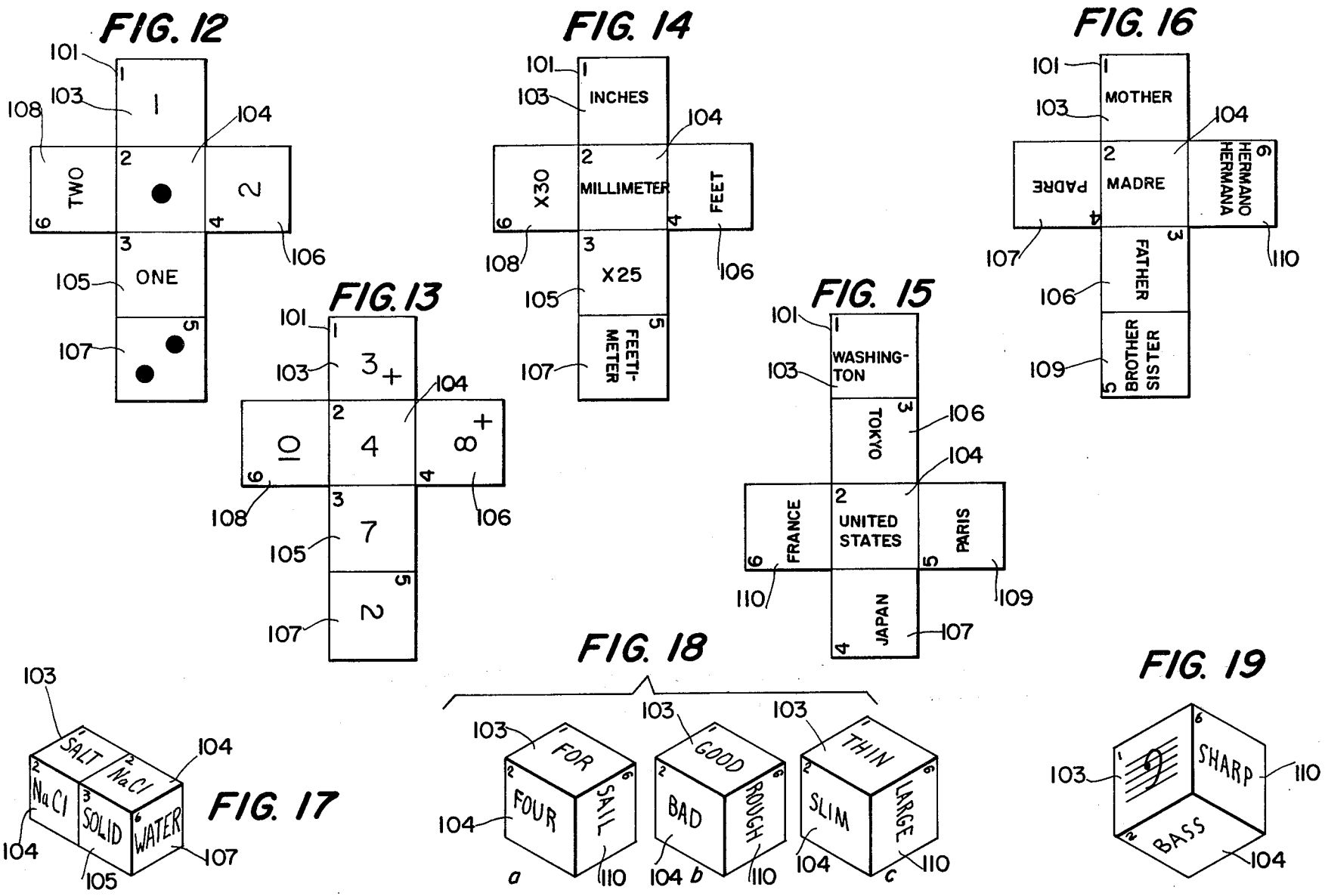
Figure 20:
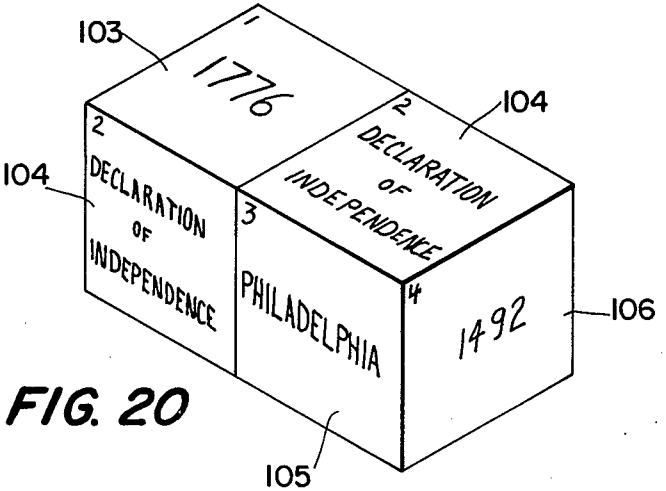
Figure 23:
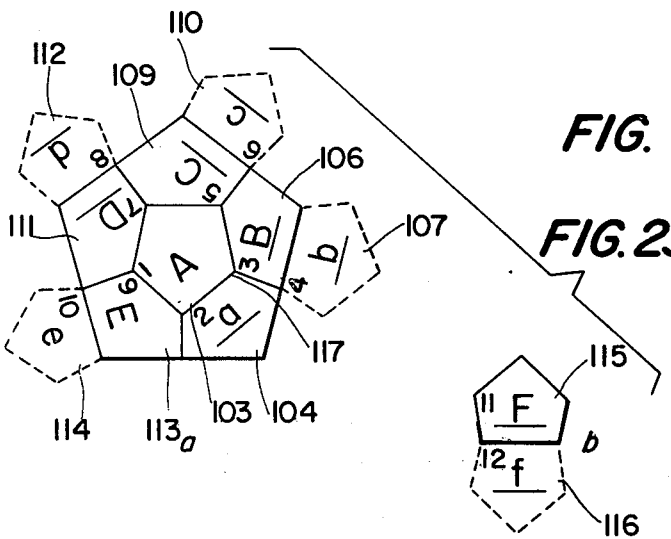

FIG. 12 is a developed view showing the relative positioning of another application of indicia (math symbols) on the surfaces of a block member in cube form in the structural orientation of FIG. 3;

FIG. 13 is a developed view showing the relative positioning of another application of indicia (mathematical operations) on the surfaces of a block member in cube form in the structural orientation of FIG. 3;

FIG. 14 is a developed view showing the relative positioning of still another application of indicia (systems of measurement) on the surfaces of a block member in cube form in the structural orientation of FIG. 3;

FIG. 15 is a developed view showing the relative positioning of still another application of indicia (geography) on the surfaces of a block member in cube form in the structural orientation of FIG. 2;

FIG. 16 is a developed view showing the relative positioning of still another application of indicia (language) on the surfaces of a block member in cube form in the structural orientation of FIG. 1;

FIG. 17 is a perspective view of two identical units showing the relative positioning of still another application of indicia (chemistry) on the surfaces of a block member in cube form in the structural orientation of FIG. 3;

FIG. 18 is a perspective view showing the relative positioning of still another application of indicia (a. homonyms, b. antonyms, c. synonyms) on the surfaces of block members in cube form in the structural orientation of FIG. 1;

FIG. 19 is a perspective view showing the relative positioning of still another application of indicia (music) on the surfaces of block members in a cube form in the structural orientation of FIG. 1;

FIG. 20 is a perspective view of two identical units showing the relative positioning of still another application of indicia (history) on the surfaces of block members in cube form in the structural orientation of FIG. 3;

FIG. 21*a* and *b* is a perspective view of two non-identical units with related indicia showing the relative positioning of still another application on indicia (art and art history) on the surfaces of block members in cube form in the structural orientation of FIG. 1;

FIG. 22*a* and *b* is a perspective view of two non-related units showing the relative positioning of still another application of indicia (symbols) on the surfaces of block members in cube form in the structural orientation of FIG. 6;

FIG. 23 is a developed view showing the relative positioning of indicia (letters of the alphabet) on the surfaces of a block member in a dodecahedron form similar in structure to that of FIG. 5;

FIG. 24*a* is a perspective view of a series of prisms showing the relative positioning of indicia (letters of the alphabet) on four surfaces of the units in the structural orientation of FIG. 4*a;*

Figure 25:
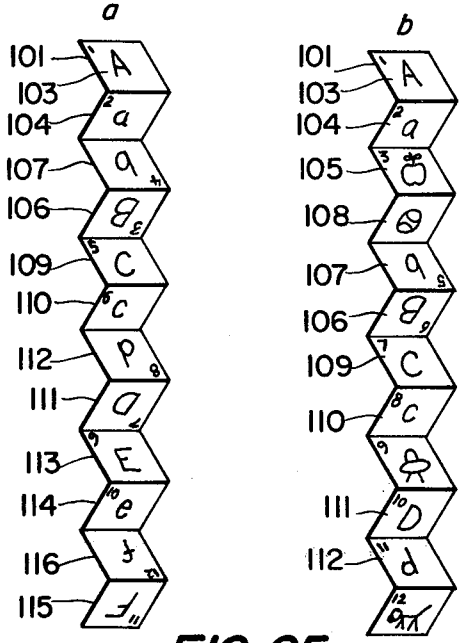

FIG. 24*b* is identical to 24*a,* but viewed from a transposed perspective;

FIG. 25*a* is a developed view showing the relative positioning of indicia (letters of the alphabet) on twelve surfaces of a prism in the structural orientation of FIG. 4*a,* using a repeated pattern of two related surfaces of a set; and FIG. 25*b* is a developed view showing the relative positioning of FIG. 4*a* in a repeated pattern of three related surfaces to a set.

CORRELATION AND EXPLANATION OF THE NUMBERS OF THE DRAWINGS TO FACILITATE REFERENCE THERETO AND TO ENHANCE LOCATION

101 identifies the numbers on the upper left corner of a surface. These numbers are to identify the surfaces of a unit for the purpose of delineating the invention and clarifying the relatedness of the surfaces. 102—identifies the arrows and "up" over them to show the position the indicia will be applied to the surface of the unit.

103—identifies the positioning of the indicia appearing on a first surface of a first set of related indicia on a unit.

104—identifies the positioning of the indicia appearing on a second surface of a first set of related indicia on a unit.

105—identifies the positioning of the indicia appearing on a third surface of a first set of related indicia on a unit.

106—identifies the positioning of the indicia appearing on a first surface of a second set of related indicia on a unit.

107—identifies the positioning of the indicia appearing on a second surface of a second set of related indicia on a unit.

108—identifies the positioning of the indicia appearing on a third surface of a second set of related indicia on a unit.

109—identifies the positioning of the indicia appearing on a first surface of a third set of related indicia on a unit.

110—identifies the positioning of the indicia appearing on a second surface of a third set of related indicia on a unit.

111—identifies the positioning of the indicia appearing on a first surface of a fourth set of related indicia on a unit.

112—identifies the positioning of the indicia appearing on a second surface of a fourth set of related indicia on a unit.

113—identifies the positioning of the indicia appearing on a first surface of a fifth set of related indicia on a unit.

114—identifies the positioning of the indicia appearing on a second surface of a fifth set of related indicia on a unit.

115—identifies the positioning of the indicia appearing on a first surface of a sixth set of related indicia on a unit.

116—identifies the positioning of the indicia appearing on a second surface of a sixth set of related indicia appearing on a unit.

117—identifies the horizontal (bar) side of a dodecahedron to show the orientation of the indicia consistent with the self-correcting concept of the invention.

The invention will be better understood from a discussion in greater detail of the drawings.

FIGS. 1, 2 and 3 show developed view of the invention detailing structural application of indicia for self-correcting purposes in three differing structural orientations as shown on cube forms.

"101" refers to the numbers in the upper left corner of a surface. These numbers are for the purpose of delineating the invention by identifying various surfaces of a unit in the explanation of drawings.

Though numbers, or other methods of coding, may be applied, the structural application of indicia on the surface of a unit is sufficient to carry out the self-correcting spirit of the invention without the need for any secondary clue. These numbers (here used in numbers 1 to 6 to accommodate the numbers of surfaces on a cube) will be used throughout most of the drawings. A cube is used in most of the drawings as this form most readily presents the ramifications of the invention. The structure or the application, however, is not limited to any one polyhedra or prism.

"102" identifies the arrow with "up" written over it to designate the direction on the surface of the unit that the indicia will be applied in order to correlate self-correctingly with one or a plurality of (other) surfaces on the same unit, or with surfaces on one or a plurality of identical or related (other) units of a series or sequence.

When assembled in cube form, it will be apparent that surfaces 1-2, 3-4, 5-6 (as identified by "101") on FIG. 1 bear related surfaces aligned on two visible planes. The juxtapositioning of each set of related indicia will show that if any two unrelated surfaces are placed in the same visible perspective the structure will be inconsistent thus providing immediate self-correction.

Thus if 2/3 or 3/1, (etc.) were placed in the same visual perspective as 1/2, 3/4 or 5/6, the indicia on one plane would be inconsistent with the structural alignment on the second plane showing all unrelatedness of the two surfaces. FIG. 1 in structured cube form bears three sets of indicia, each related on two aligned surfaces of the unit.

In FIG. 2, the related surfaces 1/2, 3/4, and 5/6 are on opposing surfaces of the unit. Thus "1" is on the top surface of the related indicia "2" is on the bottom surface. FIG. 2, as shown in cube form, bears three sets of related indicia each related on opposing surfaces of the unit.

In FIG. 3, the sets are related on three surfaces of the unit. 1/2/3 and 4/5/6 are in alignment so that 1/2 or 2/3 can appear in visual alignment on two planes. However, if 1/4, 3/6, 5/1 (etc.) or any non-related combination, were placed in this same visual alignment they would appear so inverted as to declare their unrelatedness. An inter-relationship within the sets on a single unit can, but need not necessarily, exist.

FIG. 4*a* shows the orientation of indicia on eight sides of a prism. "103" and "104" indicia are in alignment in the same direction while "106" and "107" representing a second set of related indicia are in alignment with each other but in inverted position to "103" and "104". They are also inverted to "109" and "110" representing a third set of related indicia on a unit. "111" and "112" represent a fourth set of related indicia and appear inverted to "109" and "110" and when formed into a continuum with "103" and "104" would also be inverted to them.

FIG. 4*b* shows a series of units juxtapositioned in the drawings so as to show a first set of related indicia "103" and "104" on each of the units, and a second set of related inverted on each of the units, as shown by "107".

FIG. 4*c* shows the series of units as shown in 4*b* turned around so that if an inter-relationship also existed between the sets of differing units they would, in this fashion, show a sequential alignment and a self-correcting feature. This will be more apparent when viewed with indicia applied (as in FIG. 24).

FIG. 5 shows a developed view of a structure of the invention as applied to a dodecahedron. As shown by "103" and "104" the structural alignment would be in horizontal application to the bar "117" between two surfaces. "106" and "107" show the alignment of a second set of related indicia. A third and fourth set of related indicia, following the pattern set forth on this drawing, are not visible from this perspective. A fifth set of related indicia would be positioned as "113" and "114". A sixth set would be positioned as are "115" and "116".

FIG. 6 shows a developed view of FIG. 1 carrying related letters of the alphabet as the indicia thereon to delineate the orientation. "103" and "104" the capital "A" and its feature element, the lower case "a" are in visual alignment on two planes when the plane is formed into a cube. "106" and "107" and "109" and "110" are also in the same alignment. However, "106", "107" and "110" would be inverted to "104" if placed in the same two planes of perspective.

Figure 7:
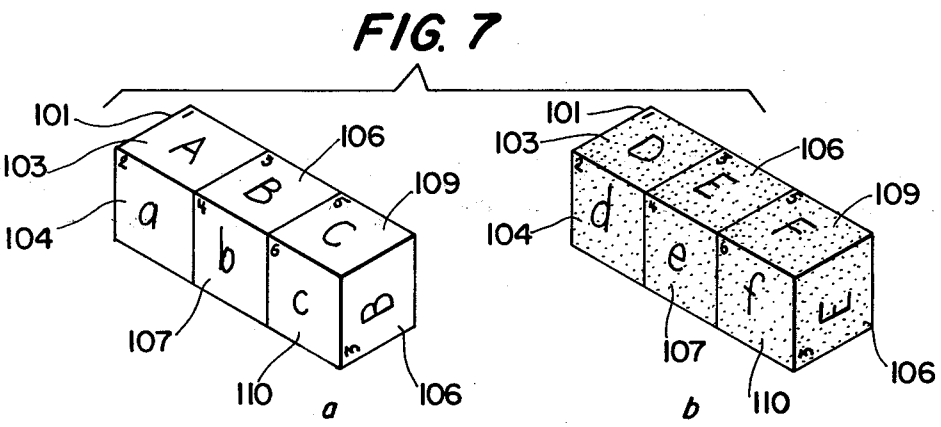

FIG. 7 shows two sets of three identical units each. The two sets shown inter-relate to form a sequence of series. ("103" "104") ("106" "107") and ("109" "110") on each of the two sets are shown juxtaposed to form a sequence. Both sets "a" and "b" are in the orientation of FIG. 6. Series "b" is shown in a different color for arbitrary coding of the invention.

FIG. 8 shows a developed view of FIG. 2 bearing letters of the alphabet as indicia to delineate the structural orientation. "103" and "104", a first set of related indicia, appear on opposing surfaces as do a second set "106" and "107") and a third set ("109" and "110").

FIG. 9 shows a perspective view of a series of three identical units of FIG. 8.

FIG. 10 shows a developed view of FIG. 3 bearing letters of the alphabet as indicia to delineate the structural orientation of FIG. 3. "103", "105" and "104" being related indicia within a first set of related indicia, and "106", "108" and "107" representing a second set of related indicia, are in three planes of rotational alignment. Any surfaces of unrelated indicia are inverted to each other in the same planes of rotational alignment.

FIG. 11 shows two units of the orientation of FIG. 10 in sequential juxtapositioning.

FIG. 12 shows a developed view bearing related feature elements of numerals as indicia in the structural orientation of FIG. 3.

FIG. 13 shows a developed view bearing related elements of mathematical operations as indicia in the structural orientation of FIG. 3. "103" represents the first surface of a first set of related indicia on the unit. It bears a numeral (3) and a mathematical operation (+). "104" represents a second surface of a first set and bears a numeral (4): "105" represents a third face of a first set and bears the numeral (7) that is the answer operation, such as applied in this example, it is essential that "103", "104", and "105" are oriented in the position shown thereon, however, in mere relatedness on three faces, as long as the first, second and third faces of a set are in the prescribed alignment it does not matter which of the three faces follow in 1, 2, 3 order as long as a prescribed pattern is established.

FIG. 14 shows a developed view as of FIG. 3 using a comparative analysis of the customary United States standard of measurement and the metric system.

FIG. 15 shows a developed view as of FIG. 2 using related geographical indicia. The example uses capitals and their countries on opposing surfaces.

FIG. 16 shows a developed view as of FIG. 1 using a comparative analysis of two different languages as indicia. "103" (Mother) is in alignment with "104" (Madre) the Spanish equivalent of "Mother." Application of the same structure is evident on the other surfaces.

FIG. 17 shows a perspective view of two identical units in the structural orientation of FIG. 3 using chemical properties as the feature elements of the indicia to show the relatedness of the subject matter on two visible planes on one of the units and on two other planes of the adjacent unit.

FIG. 18 shows a perspective view of FIG. 1 on three separate units using (a) homonyms, (b) antonyms and (c) synonyms as indicia thereon in still another subject matter application of the invention.

FIG. 19 shows a perspective view of FIG. 1 using musical terms as related indicia for another subject matter application of the invention.

FIG. 20 shows a perspective view of two identical units in juxtaposition using historical data to show the relatedness of the indicia on both visual planes on one unit and on the adjacent unit. "103" (1776) is related to "104" (Declaration of independence) on the first unit and is in the visual perspective of two planes: by rotating the second (identical) unit so that "104" (Declaration of Independence) is on the uppermost surface then "105" (Philadelphia) comes into perspective on the second plane. A third rotation of the unit would show "105" Philadelphia on the uppermost surface and "107" (Discovery of America) related to "106" (1492) would appear inverted on the second surface showing that this surface ("107") was unrelated to "105" (Philadelphia).

FIG. 21*a* shows a perspective view of two non-identical related units in the structural orientation of FIG. 1. Using Art and Art History as the feature elements of the indicia thereon. "103" (daVinci) on the first units has "104" (a picture of the Mona Lisa) as the related indicia. "103" (daVinci) on the second unit (b) has "104" (Italian) as the related indicia on the second surface of the related indicia, thus being related to and extending information on the first unit. (a).

Figure 22:
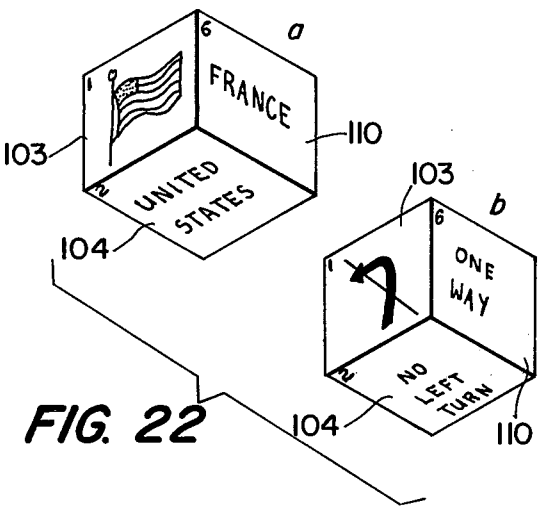

FIG. 22 shows two unrelated units in the orientation of FIG. 1 in perspective views. "a" shows indicia using symbols, as does "b". These two units are merely indications of two different applications of symbolic indicia.

FIG. 23 shows a developed view of a dodecahedron in the structural orientation of FIG. 5 using letters of the Alphabet as the related indicia to delineate the juxtapositioning of the indicia on the surfaces of a twelve faceted unit in the self-correcting spirit of the invention. "103", "104" placement, horizontal to the bar side "117" of the surface, (opposite the pointed surface) shows the top of "103" facing this pointed surface and the bottom of "104" facing the pointed part of the surface.

FIG. 23*a* shows the structural orientation of the related indicia "103", "104" as the feature elements of a first set of related indicia on the unit: "106" and "107" the elements of a second set of related indicia; "109" and "110" the elements of a third set; "111" and "112" the elements of a fourth set: and "113" and "114" as the elements of a fifth set on the same unit. A sixth set of this twelve faceted unit is shown (b) "115" and "116".

Figure 4:
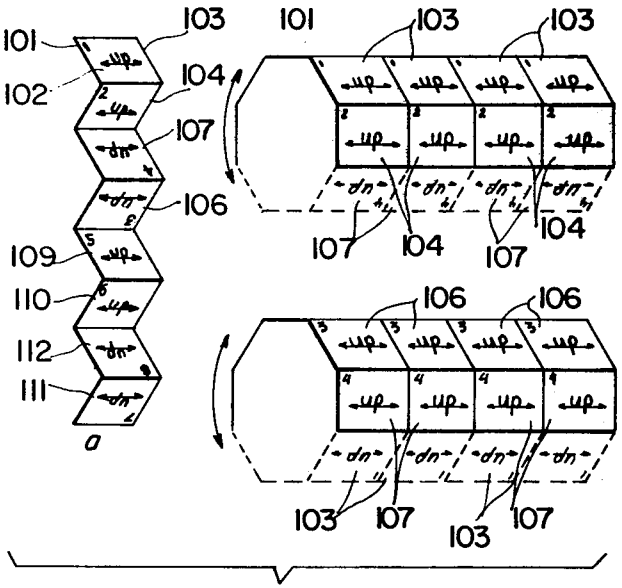
Figure 24:
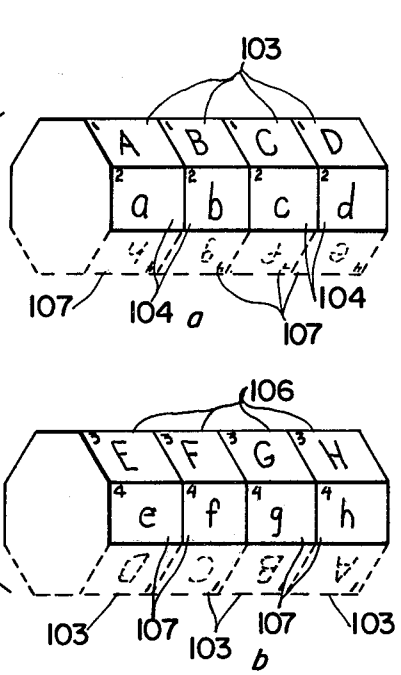

FIG. 24 shows a perspective view of a plurality of four faceted units in the structural orientation of FIG. 4.

FIG. 24*a* corresponds with FIG. 4*b* using letters of the alphabet to delineate the juxtapositioning of a series of units forming a sequence. "103" depicts indicia appearing on a first surface of a first set of related indicia on each of the four units juxtapositioned. "104" shows indicia appearing on a second surface of a first set of related indicia appearing on each of the four units shown. "107" shows indicia appearing on a second surface of a second set of related indicia appearing on each of the four units shown and the self-correcting inverted positioning of the indicia in relation to the first set of related indicia.

FIG. 24*b* shows FIG. 24*a* turned around to show the alignment of "106" and "107" the second set of related indicia on the unit on each of the four units, and how "107" indicia is inverted to "103" indicia for self-correction while in alignment with "106".

FIG. 25*a* shows a developed view of six sets of related indicia in the structural orientation of FIG. 4*a* using letters of the alphabet as indicia. Each set of related indicia in 25*a* comprises two surfaces.

FIG. 25*b* shows twelve sides of a prism, as does 25*a*. Each set of 25*b*, however, shows the same structural orientation, but in four sets of related indicia related on three surfaces to each set.

It will be apparent from the foregoing discussion and drawings that the versatility of the application of indicia on a polyhedron limits the invention to neither shape of the polyhedron nor the subject matter contained thereon. Neither is it limited to any number of indicia or combination of indicia on a surface as shown on FIG. 10 ("105") on which surface both an illustration or pictorial symbol and a morphemegrapheme appear.

Juxtapositioning of the related surfaces according to a number of structural orientations are applicable to any multi-faceted surface (solid, cylindrical . . . as FIG. 24 . . . or Flat? As FIG. 25) as self-correcting learning devices in the spirit of the invention.

The patterning determines the structural application of the related indicia and the un-related indicia, and can contain on the surfaces letters, words, numerals, symbols pictorial representations (illustrations) or any combination thereof regardless of subject matter or language. From the drawings it will be observed that the patterning can be determined from any number of structural orientation patterns. The self-correcting pattern of related and non-related surfaces, regardless of application or indicia, is the essence of the invention. The addition of other units related indicia or a change of the number of related surfaces in each set of related indicia on a unit does not stray from the spirit of the invention.

Figure 21:
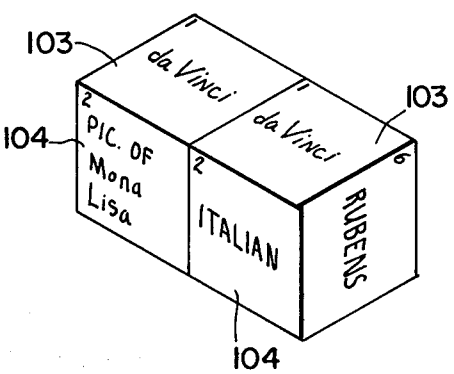

It is also apparent, as shown in FIGS. 4, 6, 7, 9, 10, 17, 20, 21 and 24 that identical or non-identical but related, units can inter-relate to form a sequence as in FIGS. 7 or 24, or expanded with inter-relationships of added information as in FIGS. 20 or 21.

A random casting of identical, or non-identical related units discloses the similarity, difference or relatedness of the surfaces that turn up, for example on FIG. 7, in which the units shown are identical, "103", "106" and "109", shown as the top surfaces, and show their similarity as all being capital letters of the alphabet. They show their difference as being different letters of the alphabet. They show their relatedness as being sequential letters of a series. However, if, in a random cast with this particular indicia, "103" "A", "110" "c" and "107" "b" had turned up there are, obviously, a number of ways of showing similarities, differences and relatedness. In FIG. 20 the relatedness of the two surfaces shown is apparent, as would be "1776" and "Philadelphia": however, if "Declaration of Independence" and "1492" turned up, it would show a difference and unrelatedness except as they would be related as "Dates in American History").

It will be seen from the foregoing that the invention teaches a manipulative, self-correcting educational apparatus and method for teaching relationships, similarities and differences that will provide the user with a manipulative tool through the use of which many learning gains can be achieved.

It consists of one or a plurality of structured multi-faceted or facially incremented units bearing a plurality of at least two sets of indicia on each unit: Each set of indicia on the unit bearing a relationship on at least two of its surfaces so structured that manipulation of the unit discloses the relationship, or lack of it, by a self-correcting positioning, of the orientation of the indicia.

The plurality of identical or non-identical related units extend the self-correcting aspect of the invention into learning games of matching similarities, differences and relatedness. This application for teaching and reinforcing by random casting or casual placement adds a valuable dimension to the learning process.

Having shown and described features of examples only of the invention, the principles can obviously be used with specifically different materials without departing from the scope and spirit of the invention.

I claim:

1. Educational teaching apparatus comprising:

(a) at least one geometrical shaped block having a plurality of faces;

(b) faces of said block having a visual presentation of subject matter thereon;

(c) said faces being disposed in at least two sets of at least two successive faces in respectively different planes of rotation of said block;

(d) said successive faces in each said set having some said visually presented subject matter thereon;

(e) the presented subject matter on the said successive faces in one said set having a basic visually recognizable similarity but a different visual physical appearance;

(f) the presented subject matter on the said successive faces in a second said set having a basic visually recognizable similarity but a different visual physical appearance;

(g) the presented subject matter of each said set on a said block being specifically different from another said set thereon;

(h) the presented subject matter on said successive faces of said set in each said plane of rotation of said block being similarly visually physically oriented, and differently visually physically oriented from that on the faces other than those of said successive faces in a given plane of rotation, and from the faces in a different said plane of rotation;

(i) rotation of a said block solely in one of said planes of rotation visually presenting the subject matter on the said successive faces in similar physical orientation as an indication of the basic similarity of subject matter, and rotation of said block in a second different plane of rotation visually presenting the subject matter on the successive faces in the second different plane of rotation in a dissimilar physical orientation from that in the said one plane of rotation as an indication of non-similarity of subject matter with respect to that in said one plane of rotation;

(j) rotation of a said block in a plane of rotation presenting a face thereon other than one of said successive faces in a said plane of rotation will visually present the subject matter on this other said face in a dissimilar physical orientation from that on the other faces in said plane of rotation as an indication of dissimilar subject matter.

2. Educational teaching apparatus comprising:

(a) a cubical block;

(b) the faces of said block each having a visual presentation of subject matter thereon;

(c) said faces being disposed in two sets of successive faces in respectively perpendicular planes of rotation of said block;

(d) said successive faces in each said set having some said visually presented subject matter thereon;

(e) the presented subject matter on the said successive faces in one said set having a basic visually recognizable similarity but a different visual physical appearance;

(f) the presented subject matter on the said successive faces in a second said set having a basic visually recognizable similarity but a different visual physical appearance;

(g) the presented subject matter of each said set on a said block being specifically different from another said set thereon;

(h) the presented subject matter on said successive faces of said set in each said plane of rotation of said block being similarly visually physically oriented, and differently visually physically oriented from that on the faces other than those of said successive faces in a given plane of rotation, and from the faces in a different said plane of rotation;

(i) rotation of a said block solely in one of said planes of rotation visually presenting the subject matter on the said successive faces in similar physical orientation as an indication of the basic similarity of subject matter, and rotation of said block in a second different plane of rotation visually presenting the subject matter on the successive faces in the second different plane of rotation in a dissimilar physical orientation from that in the said one plane of rotation as an indication of non-similarity of subject matter with respect to that in said one plane of rotation;

(j) rotation of a said block in a plane of rotation presenting a face thereon other than one of said successive faces in a said plane of rotation will visually present the subject matter on this other said face in a dissimilar physical orientation from that on the other faces in said plane of rotation as an indication of dissimilar subject matter.

3. Educational teaching apparatus as claimed in claim 2 including two identical cubical blocks, each having on the respective faces thereof, and in the respective rotational planes thereof, identical visual subject matter presentations, the second said block accordingly constituting a duplication of a first said block and with the same correlated substance as on the first said block; and said indicia in one said set being so visually aligned in said first plane of rotation with respect to one another, and the indicia in said second set being so visually aligned in said second plane of rotation with respect to one another, but in a different alignment with respect to the indicia of said first set, whereby comparison of the subject matter thereon on one said member with respect to that of a second said member will visually present, correct or incorrect correlated subject matter on adjacent ones of said members dependent on subject matter and the positional arrangement thereof on said faces of said members to facilitate instructional educational recognition and correlation of the material by visual comparison of the faces of one member with respect to the faces of an adjacent member, due, at least in part, to the difference in alignment of the visually presented subject matter in said sets on the respective said members, and additionally facilitating a user self-correction of orientation and therewith indicia substance.

4. Educational teaching apparatus as claimed in claim 3 including on each cubical block three sets of visually presented subject matter in three respective different rotational planes and being positioned on two successive faces in the said respective rotational planes.

* * * * *